United States Patent [19]

Bobnar

[11] 4,172,582

[45] Oct. 30, 1979

[54] REVERSE DIFFERENTIAL HOLDING VALVE

[75] Inventor: Louis R. Bobnar, Sarasota, Fla.

[73] Assignee: Rexnord Inc., Milwaukee, Wis.

[21] Appl. No.: 789,753

[22] Filed: Apr. 21, 1977

[51] Int. Cl.[2] ..... F161K 31/122

[52] U.S. Cl. ..... 251/63; 91/420; 251/63.5; 251/282

[58] Field of Search ..... 91/420; 251/63, 63.5, 251/282, 44; 137/599

[56] References Cited

U.S. PATENT DOCUMENTS

| | | | |
|---|---|---|---|
| 1,720,705 | 7/1929 | Waterman | 251/282 |
| 2,897,836 | 8/1959 | Peters et al. | 251/282 |
| 3,282,552 | 11/1966 | Sommese, Sr. | 251/44 |
| 3,472,261 | 10/1969 | Brannon | 91/420 |
| 4,018,136 | 4/1977 | Kaetterhenry | 91/420 |

FOREIGN PATENT DOCUMENTS

| | | | |
|---|---|---|---|
| 59905 | 6/1942 | Denmark | 251/44 |

*Primary Examiner*—Martin P. Schwadron
*Assistant Examiner*—G. L. Walton

[57] ABSTRACT

A pilot operated hydraulic holding valve includes a poppet valve member which is biased to close by the pressure generated by the load being held in direct proportion to the magnitude of that pressure, thereby eliminating the need for mechanical biasing means and reducing the pilot pressure required to open the valve at low load pressures.

2 Claims, 2 Drawing Figures

REVERSE DIFFERENTIAL HOLDING VALVE

BACKGROUND OF THE INVENTION

Hydraulic holding valves and counterbalance valves are well known in the art. Such valves are functionally similar and both are used to control an overrunning or overhauling load in a hydraulic system. A holding valve may be characterized simply as a "zero leak" counterbalance valve. Thus, a holding valve may, for example, be used to maintain the load carrying boom of a crane, operated by a hydraulic cylinder, in a fixed position, where any downward movement through fluid leakage and resultant retraction of the cylinder would be undesirable or dangerous.

In the prior art, holding valves and counterbalance valves utilize a spring to bias the valve closed against the hydraulic pressure being held in the cylinder or other hydraulic actuator. A holding valve of this type is opened for releasing the load by applying hydraulic pressure, in addition to the system pressure being held, sufficient to overcome the spring force holding the valve closed. This additional pressure is generally supplied by pilot pressure produced by reversing the system flow to the cylinder to release the load. The bias spring must obviously be strong enough to hold the valve closed against a pressure somewhat greater than the maximum desired system holding pressure and, thus, at low system pressures, the added pressure required to overcome the spring force and open the valve is high. Much more energy is therefore required to provide pilot opening pressure at low load pressures than at high pressures. Furthermore, since the bias spring is the only means by which the valve is held closed and the load holding pressure maintained, spring failure will render the valve inoperative and, if the spring should fail when a load is being held, serious damage or injury could result. Also, at high load holding pressures, leakage and loss of holding pressure is more likely to occur simply because that pressure acts against a constant spring force.

SUMMARY OF THE INVENTION

In the present invention, a poppet type holding valve is constructed so that hydraulic pressure on the load holding side of a cylinder or other actuator acts on the valve member to bias the poppet to a closed position. Load created pressure of any magnitude will thus hold the valve closed and the need to rely on mechanical spring force to hold the valve closed is eliminated. The pilot pressure required to open this valve is directly proportional to the trapped load holding pressure and, thus, at low holding pressure the pilot opening pressure is correspondingly low and unneeded energy is thereby conserved.

DESCRIPTION OF THE PREFERRED EMBODIMENT

Figure 1:
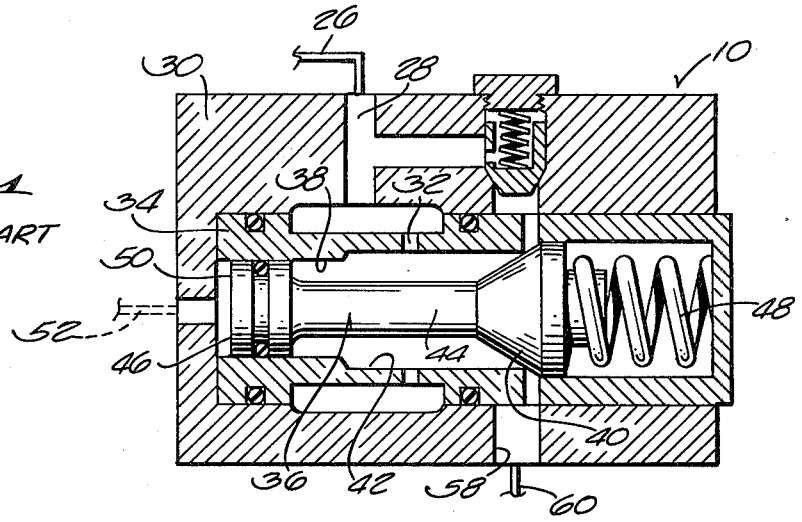
Fig. 1 PRIOR ART
FIG. 1 is a cross sectional view of a prior art holding valve including a schematic representation of a basic hydraulic system in which it is used.
Figure 2:
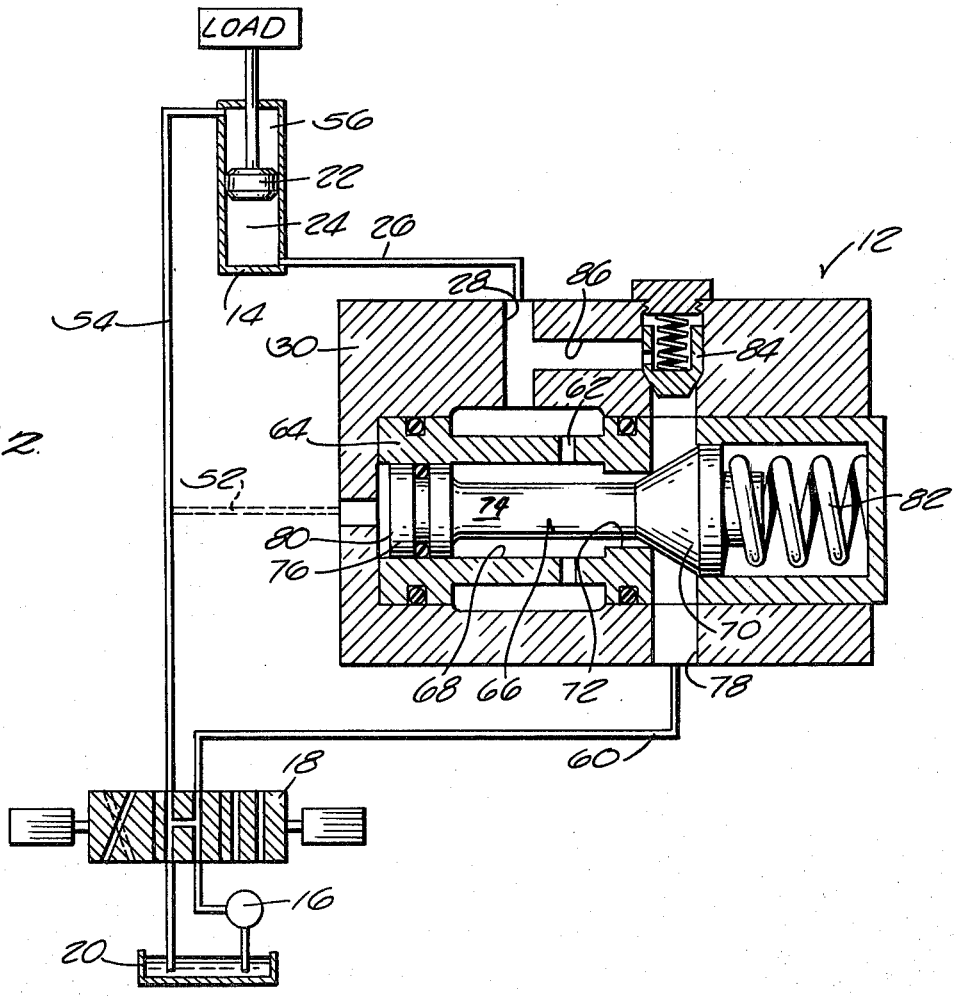
FIG. 2 is a cross sectional view of the holding valve of the present invention shown in the same system schematic as the prior art valve of FIG. 1.

In the drawing, FIGS. 1 and 2 show, respectively, a prior art holding valve 10 and a holding valve 12 of the present invention. Both valves are shown installed in schematic representations of the same hydraulic system. In the system, a hydraulic cylinder 14 is used to raise and lower a load by means of fluid under pressure supplied by a pump 16. Fluid flow in the system is controlled by a standard four-way directional control valve 18, operable in any conventional manner such as manually or by solenoid (not shown). Control valve 18 is shown centered with the pump 16 pumping directly to the tank 20 so that there is no flow into or from the system.

As shown in the systems, the piston 22 of cylinder 14 has been extended and the load is being held in the raised position by prior art holding valve 10 in FIG. 1 and the holding valve 12 of this invention in FIG. 2, respectively. Thus, referring particularly to FIG. 1, the fluid pressure of the load on the cap end 24 of the cylinder 14 is transmitted through line 26, port 28 in the main body 30 of valve 10, port 32 of the valve seat 34, and into communication with the poppet valve member 36. Valve seat 34 has a stepped bore, including a first diameter portion 38 opposite the poppet 40 and a larger second diameter portion 42 adjacent to the poppet. The poppet valve member 36 includes a spool 44 which interconnects the poppet 40 and a piston 46, the piston being disposed in the first diameter portion 38 of the valve seat 34. The fluid pressure of the load being held acts on the differential areas of the poppet valve member 36 with a resultant pressure tending to unseat the poppet 40 and open the valve (the area of the poppet 40 within second diameter portion 42 being slightly larger than the area of piston 46 within first diameter portion 38). The poppet 40 is held closed and the holding pressure thus maintained by the force of bias spring 48 against the outside of the poppet.

To assist in opening prior art valve 10, the piston 46 of valve member 36 has an outer pilot pressure surface 50 connected by pilot pressure 52 to supply line 54 connecting control valve 18 and the rod end 56 of the cylinder 14. When it is desired to retract the cylinder and lower the load, control valve 18 is shifted to the extreme right, pump flow from pump 16 is directed through line 54 to the rod end 56. Simultaneously, the pilot pressure in pilot line 52 acts on pilot pressure surface 50 to overcome the bias spring force holding the poppet 40 closed; when the poppet unseats, the pressurized fluid being held passes through the valve, out port 58, through line 60 and control valve 18 to tank 20.

Since bias spring 48 is selected to be strong enough to hold the poppet 40 closed against the pressure differential imposed on valve member 36 by the maximum load for which the system is designed, it will be appreciated that at low load levels, the lower induced load pressure differential will require substantially higher pilot pressure to open the holding valve. In this situation, unnecessarily high amounts of energy are required to be consumed to drive the pump 16 simply to create sufficient pilot pressure to open the valve and hold it open for retraction of the cylinder.

In FIG. 2, the holding valve 12 of the present invention is shown in the same system as the prior art valve 10 of FIG. 1, and the schematically shown system components as well as certain similar elements of the valve are the same. Thus, the fluid pressure of the load on the cap end 24 of cylinder 14 is transmitted through line 26, port 28 in the main body 30 of valve 12, port 62 of the valve seat 64, and into communication with the poppet valve member 66. Valve seat 64 has a bore which is stepped oppositely to that of prior art seat 34 and, thus, includes a first diameter portion 68 opposite the poppet 70 and a smaller second diameter portion 72 adjacent to the poppet. The poppet valve member 66 includes a spool 74 which interconnects the poppet 70 and a piston 76, the piston being disposed in the first (larger) diameter portion 68 of the valve seat 64. The first internal pressure surface comprising the area of the net cross-sectional piston 76, which area is perpendicular the longitudinal axis of spool 74 and within first diameter portion 68, is slightly larger than the second internal pressure surface comprising the net cross-sectional area of the poppet 70, which area is perpendicular the longitudinal axis of spool 74 and within the second diameter portion 72. As a result, the fluid pressure of the load being held acts on the differential first and second internal pressure surfaces of the poppet valve member 66 with a resultant pressure tending to seat the poppet 70 and hold the valve closed. As contrasted to the prior art, the poppet 70 is held closed and the holding pressure maintained by the trapped system pressure itself, and no bias spring is needed.

Valve 12 also utilizes pilot pressure in line 52 acting on outer pilot pressure surface 80 on piston 76 to open against the holding pressure differential. Since pilot pressure surface 80 has a substantially greater area than the area of the opposed differential internal pressure surfaces, relatively lower levels of pilot pressure are required to open the holding valve. Furthermore, at low load levels, the lower induced load pressure differential holding the valve closed may be overcome and the valve opened by proportionately lower pilot pressures. Thus, contrary to the prior art valve 10, the reverse pressure differential used to maintain holding pressure in the present invention avoids the consumption of unnecessarily high amounts of energy to open the valve for retracting the cylinder. In addition, the higher the load holding pressure in the valve disclosed herein, the greater the force being exerted to hold the poppet 70 on its seat 64 and, as a result, leakage due to minor defects in the sealing surfaces is much less likely to occur.

Although a bias spring is not required for normal operation of the valve disclosed herein, it is desirable to have a light, high rate bias spring 82 to enhance the overall valve operation. Spring 82 will thus perform certain important peripheral functions, such as modulation of flow and elimination of undesirable fluctuations in flow through the valve when opened. This spring will also assure that the valve is biased to close in a no load condition where back-pressure in the system might tend to push it open.

The load in the cylinder 14 is extended in a typical and well known manner. Control valve 18 is shifted to the extreme left and pump flow is directed through line 60 and into valve 12 via port 78, through free flow check valve 84 and passage 86 to port 28, and through line 26 to the cap end 24. Simultaneously, the hydraulic fluid in the rod end 56 is exhausted through line 54 and control valve 18 to tank 20. Although check valve 84 is shown as an integral part of valve 12, it will be understood that the check valve could as well be independently disposed in a separate line and, therefore, forms no part of this invention.

Normally, a holding valve used in a system described herein will, for reasons of safety, be attached directly to the cap end 24 of the cylinder, thereby eliminating line 26 and the inherent danger in a break or leak that could occur in that line.

I claim:

1. A pilot operated hydraulic holding valve for maintaining the load on a hydraulic actuator in a fixed position, comprising:

(a) a valve body having a bore with first and second diameter portions;

(b) a fluid port in the valve body providing direct and open fluid pressure between the bore and the pressurized load holding end of the actuator;

(c) a valve member disposed in the bore and movable therein between a closed holding position and a piloted open position, said valve member having opposed first and second internal pressure surfaces, and further including:

(1) a poppet disposed in the second diameter portion of the bore to provide the second internal pressure surface and adapted to cooperate with a seat in the valve body to provide the closed holding position;

(2) a spool attached at one end to the poppet and disposed axially in the bore;

(3) a piston attached to the opposite end of the spool and disposed in the first diameter portion of the bore to provide the first internal pressure surface; and, (4) an outer pilot pressure surface on the face of the piston opposite the first internal pressure surface and exposed to a pressure source;

(d) the first and second internal pressure surfaces being in continuously open fluid pressure with the fluid port;

(e) the net cross-sectional area of the first internal pressure surface being greater than the net cross-sectional area of the second internal pressure surface; and, (f) said closed holding position will always be maintained as long as the net fluid pressure acting on the first and second internal pressure surfaces is in excess of the pressure source acting on said outer pilot pressure surface;

whereby the net fluid pressure on the internal pressure surfaces holds the valve closed by a differential force directly proportional to the load being held, and allows the valve to be piloted to its open position by pilot pressure directly proportional to said load.

2. A holding valve as defined in claim 1 wherein the area of said outer pilot pressure surface is substantially greater than the net cross-sectional area of said first internal pressure surface.

* * * * *